United States Patent [19]

Neilsen et al.

[11] Patent Number: 4,688,457

[45] Date of Patent: Aug. 25, 1987

[54] HEAVY DUTY PAPER PUNCH

[75] Inventors: Hildaur L. Neilsen, Metuchen; Richard A. Davi, Glenwood, both of N.J.

[73] Assignee: Rolodex Corporation, Secaucus, N.J.

[21] Appl. No.: 787,701

[22] Filed: Oct. 15, 1985

Related U.S. Application Data

[63] Continuation of Ser. No. 456,836, Jan. 10, 1983, abandoned.

[51] Int. Cl.[4] ..... B26F 1/02

[52] U.S. Cl. ..... 83/468; 83/549; 83/618; 83/633; 83/697

[58] Field of Search ..... 83/618, 633

[56] References Cited

U.S. PATENT DOCUMENTS

| | | | |
|---|---|---|---|
| 1,687,758 | 10/1928 | Glaeser | 83/618 |
| 2,102,292 | 12/1937 | St. Louis et al. | 83/618 |
| 2,373,121 | 4/1945 | Kipp | 83/633 |
| 3,176,570 | 4/1965 | Gaya | 83/618 |
| 4,036,088 | 7/1977 | Ruskin | 83/618 |

*Primary Examiner*—Donald R. Schran
*Assistant Examiner*—James L. Wolfe
*Attorney, Agent, or Firm*—Robert E. Burns; Emmanuel J. Lobato

[57] ABSTRACT

A double duty paper punch for punching selected combinations of holes in up to fifty sheets of paper comprises a die-cast base with a steel die plate of angle cross section seated on the base with a downwardly projecting flange received in a recess in the base. An elongate punch holder, also a die casting, has a rear portion seated on a rear portion of the die plate and a forward portion spaced upwardly from the die plate to receive the paper to be punched. Rivets through aligned holes in the punch holder, die plate and base secure these parts together. The punch holder has a plurality of punch-receiving bores aligned with holes in the punch plate and base selectively to receive individual punches, each having a stem and a head with a spring acting between the head and the punch holder to hold the punch in raised portion. A punch actuator pivotally connected to the base is also a die casting with a rear portion overlying the punch holder and a spaced parallel handle portion overlying a forward portion of the base. A steel cam rod nested between ribs on the underside of the punch actuator is engageable with heads of punches positioned in the punch holder to force the punches down through the paper to be punched when the handle position is pressed down.

14 Claims, 8 Drawing Figures

HEAVY DUTY PAPER PUNCH

This is a continuation, of application Ser. No. 456,836, filed Jan. 10, 1983, now abandoned.

FIELD OF INVENTION

The present invention relates to a heavy duty paper punch suitable for office use.

BACKGROUND OF THE INVENTION

There are many paper punches presently available. Some are designed to punch single holes while others are designed to punch two, three or more holes in the paper. Of the multiple hole punches, some have punches of which the spacing is fixed while others are adjustable. With adjustable punches there is a problem of setting the punches accurately to provide the desired hole spacing. Some paper punches are designed for light duty for use in punching single sheets or a small number of sheets. Others are designed for heavy duty for use in punching a larger number sheets at one time. Heavy duty punches for punching multiple holes are customarily heavy so that they are inconvenient to handle. One type of heavy duty punch comprises individual screw-type punches which are operated independently. While such punches will penetrate a large number of sheets of paper, they are inherently slow. Moreover, extreme care must be exercised to assured proper spacing of the holes.

SUMMARY OF THE INVENTION

The present invention is directed to providing a double-duty paper punch which is capable of punching a large number of sheets of paper, for example fifty sheets, and is also capable of punching cleanly a single sheet of paper.

Moreover, the invention is directed to providing a paper punch which is of rugged construction and capable of heavy duty and yet is sufficiently light in weight that it can be handled easily be secretarial pesonnel. Moreover, the punch is easy to operate.

A further feature of the paper punch in accordance with the present invention is that it can be easily and quickly set to punch any of a number of different hole spacings with the assurance that the spacing of the holes punched will conform precisely to standard hole spacings.

A paper punch in accordance with the present invention comprises a generally rectangular base having adjacent its rear edge a longitudinally extending seat for a die plate. An elongate die plate is seated on this seat and secured to the base. In a forward portion of the die plate there are provided longitudinally spaced holes coincident with holes provided in the base. An elongate punch holder has a rear portion which seats on a rear portion of the die plate and is secured to the die plate and the base. A forward portion of the punch holder overlies the forward perforate portion of the die plate and is spaced upwardly therefrom to receive the paper to be punched. In it there are punch-receiving bores aligned with the punch holes of the die plate.

A plurality of individual punches are insertable in selected punch-receiving bores of the punch holder. Each of the punches has a cylindrical stem portion which is slidably and removably recievable in bores of the punch holder and an enlarged head at the upper end of the stem. A compression spring surrounding the stem of each punch acts between the head of the punch and an upper surface of the punch holder to position the punch normally in an upper position in which the lower end of the punch is above the lower face of the forward portion of the punch holder.

Punch actuating means pivotally mounted on the base comprises a forwardly extending handle portion for manual movement of the punch actuating means from an upper position to a lower position. A longitudinally extending contact bar on the lower side of the punch actuating means is engageable with heads of punches in selected bores of the punch holder to move the punches from their initial normal raised position to a lower position in which lower ends of the punches penetrate the paper to be punched and enter the holes in the die plate.

Preferably the base, punch holder and punch acutating means are aluminum die castings which provide strength with light weight. The die plate and punch contact bar of the actuating means are made of steel.

BRIEF DESCRIPTION OF DRAWINGS

The nature objects and advantages of the invention will be more fully understood from the following description of a preferred embodiment shown by way of example in the accompanying drawings in which.

DESCRIPTION OF PREFERRED EMBODIMENT

Figure 1:
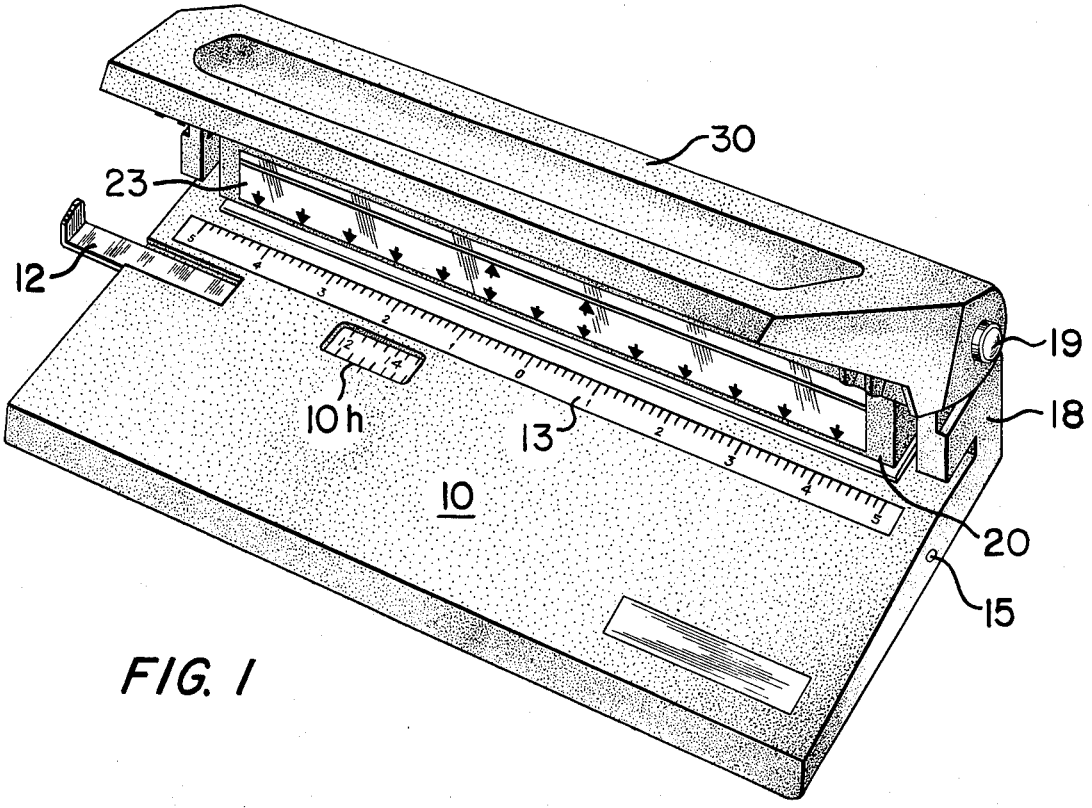
FIG. 1 is a perspective view in accordance with the present invention.
Figure 2:
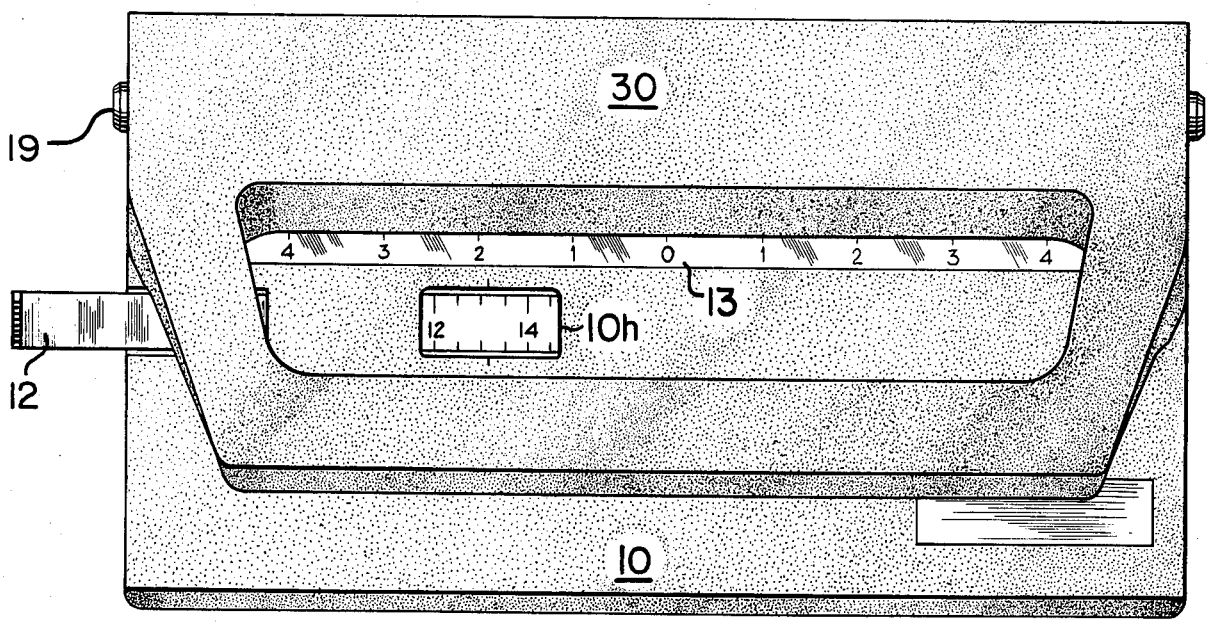
FIG. 2 is a top plan view of the punch.

As shown by way of example in the drawings, a double duty paper punch in accordance with the present invention comprises a generally rectangular base 10 on which is secured a die plate 11, a punch holder 20 mounted on the base and adapted to receive a plurality of individual punches 21 and a punch actuator 30 pivotally connected to the base 10 and operable to actuate punches positioned in the punch holder.

The base 10 is preferably an aluminum die casting with an upper surface 10*a* and downwardly extending peripheral flanges 10*b* including a rear flange 10*c*, and intermediate reinforcing flanges of which one, 10*d*, is parallel to the rear flange 10*c*. Along its rearward edge, the base 10 is provided with a recessed seat 10*e* to receive the elongate die plate 11 so that the upper face of the die plate is substantially flush with an adjacent portion of the upper surface 10*a*. The die plate 11 is formed of steel and the forward edge is bent down to form a flange 11*a* which is received in a longitudinally extending groove 10*f* in the base. The flange 11*a* not only strengthens the die plate but also serves to position it on the base. Moreover, the bending of the die plate provides a rounded corner 11*b* which facilitates insertion of paper into the punch. The die plate is provided with a plurality of punch holes 11*c* arranged on a line extending longitudinally of the die plate. The holes 11*c* are spaced from one another according to standard spacings of holes in paper for use in notebooks, binders, ledgers and the like. The base 10 is provided with holes 10g aligned with the holes 11c of the die plate to provide for passage of paper punchings. The holes 10g in the base are preferably slightly larger than the holes 11c in the die plate.

The base 10 is provided with a calibrated paper guide 12 which is slidable longitudinally of the base. A window 10h is provided in the base for reading calibrations on the paper guide. Moreover, just in front of the die plate 11 there is provided a scale 13 which is recessed in the base so that its upper surface is flush with the upper surface of the base.

A dump tray 14 is prov ided below the holes 10g in the base to catch paper punchings. The dump tray is hingedly mounted in the base by means of rivets 15 so that it can be swung by means of a tab 16 to open position for emptying the punchings. Spring washers on the rivets 15 between end flanges of the dump tray and end flanges of the base hold the dump tray in whatever position it is put. Moreover, the base 10 is provided at its corners with rubber feet 17 so that the punch will not slip and will not mar furniture on which it is placed.

The elongate punch holder 20 is also preferably formed as an aluminum die casting. A rear portion of the punch holder seats on a rear portion of the die plate 11 and rivets 22 extending through holes in the bottom of wells 20a in the punch holder and aligned holes in the die plate and base secure the punch holder and die plate to the base. It will be seen from FIG. 6 that the rivets 22 are between the flanges 10c and 10d of the base, which is thereby strongly reinforced. Around each rivet the lower face of the rear portion of the punch holder 20 is provided with a rectangular pad 20b which rests on the upper surface of the die plate 11. Positioning of the punch holder on the die plate in this manner by spaced pads avoids the problem of obtaining exactly matching surfaces throughout the length of the punch holder. Moreover, front and rear portions of the pads are slightly higher, with an intermediate recessed portion, so that when the rivets 22 are set, adjacent portions of the punch holder are slightly flexed so that the punch holder is resiliently held firmly on the die plate.

The lower face of a front portion of the punch holder is spaced from the die plate for insertion of the paper to be punched. The space is sufficient to receive 50 sheets of 16 lb. bond paper. Vertical bores 20c in the punch holder are aligned with holes 11c in the die plate to receive punches 21. Each of the bores 20c is in a column portion 20d extending down from the upper surface of the die casting of the punch holder. Internal webs 20g connect these column portions with a forward flange 20e and intermediate flange 20f to provide a rugged construction while conserving both metal and weight. An index plate 23 set flush in the forward face of the punch holder indicates the positions of the bores 20c.

Figure 6:
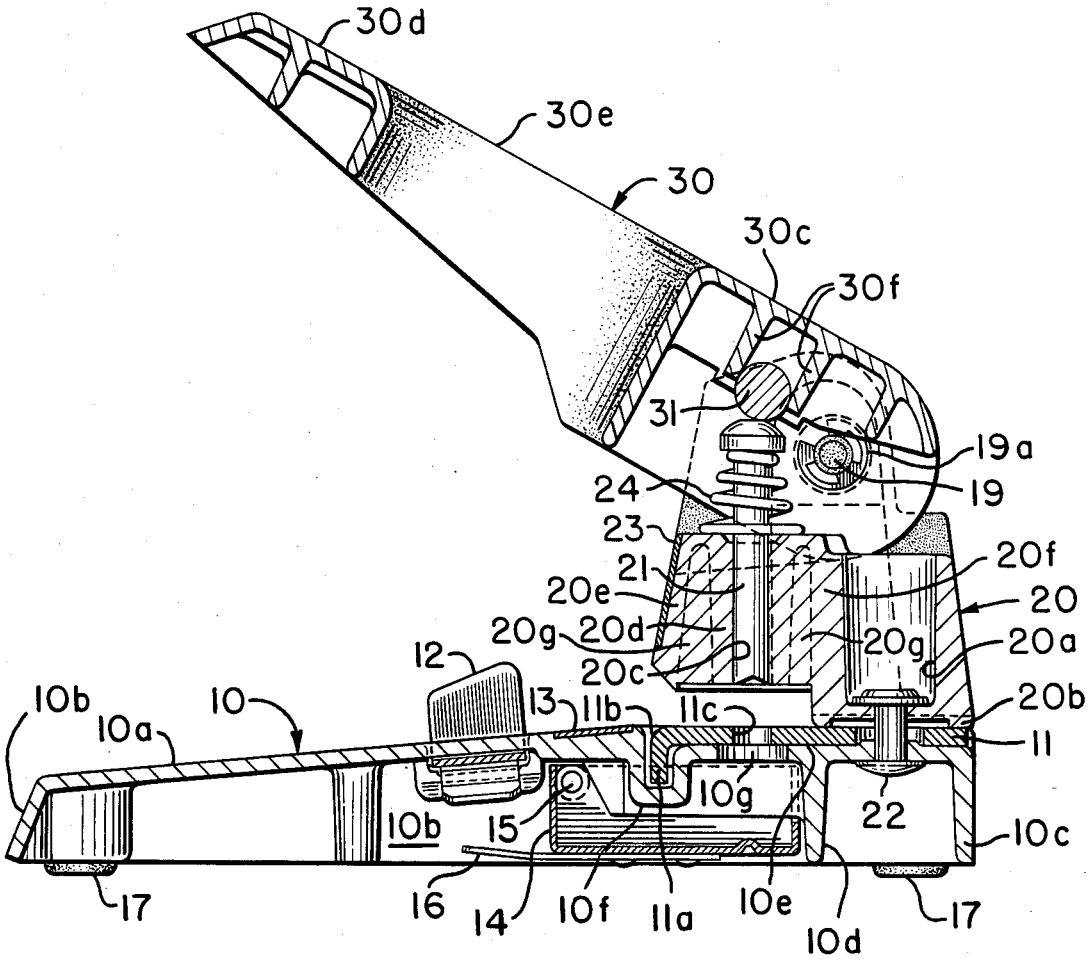
FIG. 6 is a cross section taken approximately on the line 6—6 in FIG. 3.
Figure 8:
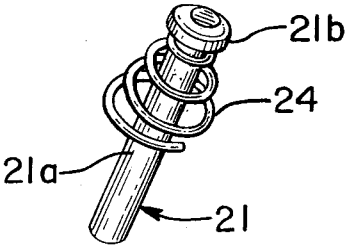
FIG. 8 is a perspective view of one of the punches and its associated spring.

Each of the punches 21 comprises a cylindrical stem portion 21a (FIG. 8) and a head portion 21b. The stem portion 21a comprises a section of a steel rod which fits snuggly in the bores 20c of the punch holder so as to slide freely therein while being held in precise alignment with the holes 11c of the die plate 11. The lower end of the punch is concave to facilitate punching the paper. The head 21b of each punch is made of compacted powdered metal to provide a porous structure for the storage of a lubricant. The punches 21 are individually inserted in selected bores 21c of the punch holder 20. When a punch is in place in the punch holder as illustrated in FIG. 6, it is normally held in raised position by a spiral spring 24 which acts between the head of the punch and the upper surface of the punch holder. The upper end of the spring is secured to the punch so that the spring does not separate from the punch when removed from the punch holder.

Figure 3:
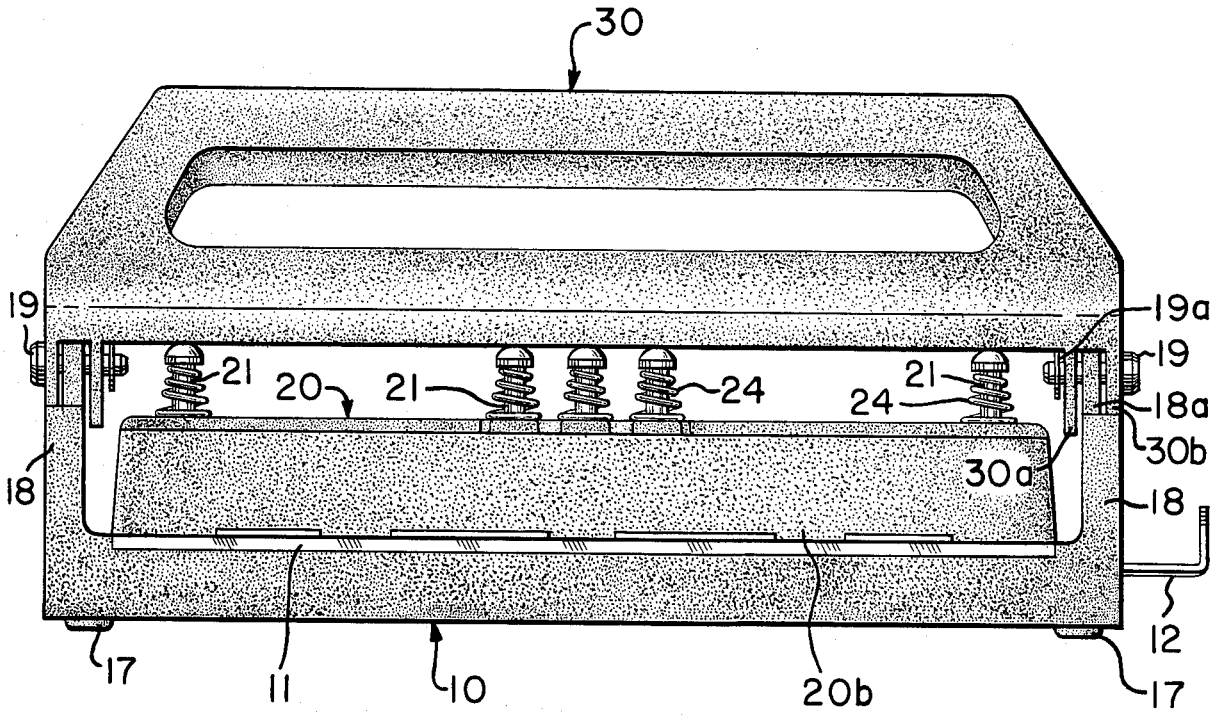
FIG. 3 is a rear elevation.
Figure 4:
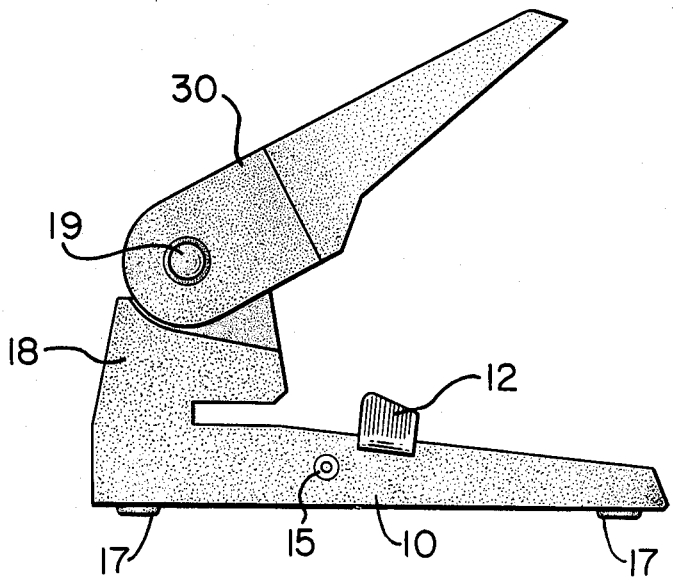
FIG. 4 is an end view.

The punch actuator 30 preferably also formed as an aluminum die casting is privotally mounted on upstanding portions 18 at opposite ends of the base 10. As seen in FIG. 3 an apertured pivot portion 18a of the upstanding portion 18 is sandwiched between apertured pivot portions 30a and 30b of the punch actuator 30. A pivot pin 19 extends through aligned apertures in the aforesaid pivot portions and is secured by a split ring 19a. This three-part hinge construction provides a strong pivotal connection to withstanding the high forces generated when punching several holes simultaneously in a large number of sheets of paper. The punch actuator 30 has a rear portion 30c overlying the punch holder 20 and a forward handle portion 30d which is parallel to and spaced from the rear portion 30c. At its opposite ends the handle portion 30d is connected with the rear portion 30c by end portions 30e. As seen in FIG. 3, the handle portion 30d extends substantially the full length of the punch acutator and provides room for gripping the handle portion with two hands so as to apply sufficient pressure to the punch actuator to punch a large number of sheets of paper simultaneously. The rear portion 30c, handle portion 30d and end portions 30e are defined by upper surfaces and downwardly extending flanges to provide an attractive and strong structure with light weight. On the underside of the rear portion 30c of the punch actuator, a steel cam bar 31 is nested between two flanges 30f. The cam bar 31 is positioned to engage the heads of punches 21 positioned in the punch holder 20 as illustrated in FIG. 6. When the handle portion 30d of the punch actuator is pushed downwardly to rotate the punch actuator in a counterclockwise direction as viewed in FIG. 6 the cam bar 31 presses downwardly on the punches to force them through paper positioned between the forward portion of the punch holder and the die plate and into punch holes 30c in the die plate 11. Upon the handle of the punch actuator being released, the springs 24 of the punches return the punches and punch actuator to the position shown in FIG. 6. The low friction engagement of the cam bar 31 with the self-lubricated heads 21b of the punches 21 reduces wear and contributes to easy operation of the punch.

Figure 5:
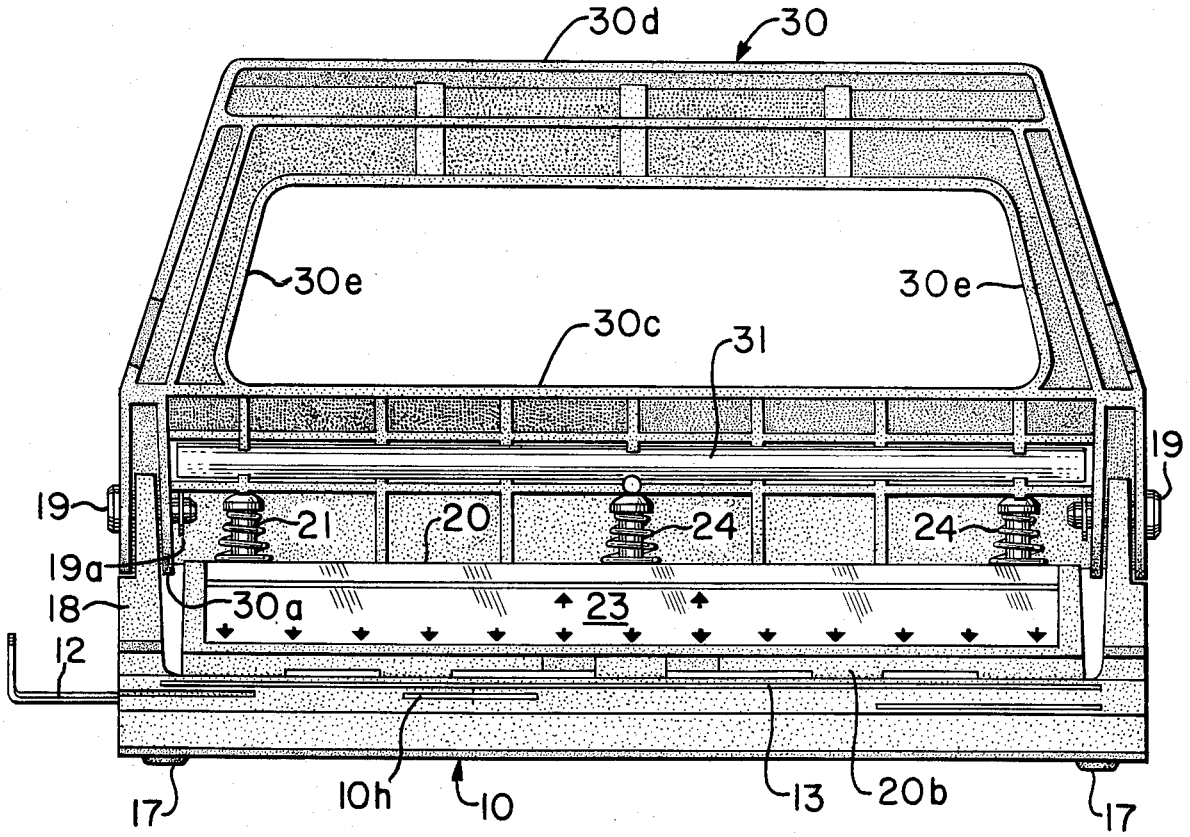
FIG. 5 is a front elevation with the handle raised to an approximately vertical position.
Figure 7:
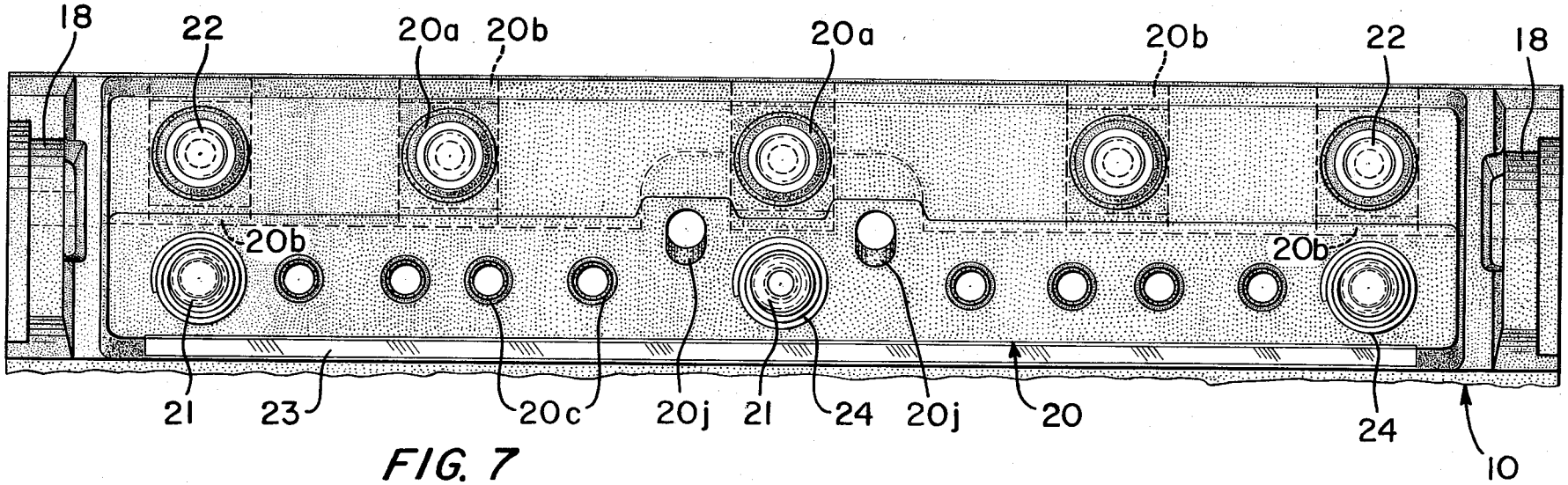
FIG. 7 is a plan view of the punch holder.

From the position shown in FIG. 6, the punch actuator 30 can be raised to the position shown in FIG. 5 in which it extends almost vertically. When the punch actuator 30 is in this raised position, individual punches can be lifted out of the respective bores of the punch holder 20 and placed in other bores so as to provide the number of holes and spacing of holes desired. Moreover, as seen in FIG. 7 the punch holder 20 is provided with two parking bores 20j for the storage of punches which are not being used. The parking bores 20j are positioned rearwardly of the punch bores 20c so that the heads of the punches are not engaged by the cam bar 31. As illustrated in FIG. 7, the parking bores 20j are of oval shape with their major axes perpendicular to the length of the punch holder to facilitate insertion of the punches.

In using the punch, the punch actuator 30 is raised to the position shown in FIG. 5 and punches are inserted in selected bores of the punch holder to provide the desired spacing of the holes to be punched. In FIG. 5, punches are shown in three bores to provide holes for a standard three-hole binder. Since the bores are accurately positioned in the manufacture of the punch, exact spacing of the punched holes is assured. Moreover, the bores in the punch holder are preferably reamed after assembly of the punch holder on the base to assure that the punches are precisely aligned with the punch holes in the die plate 11. In order to punch cleanly a single sheet or as many as 50 sheets, the diameter of the punch holes in the die plate 11 are precisely calibrated with respect to the diameter of the punches. In order to punch as many as 50 sheets, the holes in the die plate are slightly larger than the punches. However, they must not be too large since otherwise a single sheet cannot be cleanly punched.

While a preferred embodiment of the invention has been illustrated in the drawings and is herein particularly described, it will be understood that variations may be made and that the invention is in no way limited to the illustrated embodiment.

What we claim is:

1. A heavy duty paper punch comprising: an elongate, generally rectangular base having an upper surface, a front edge, a rear edge and opposite ends, said base having at opposite ends thereof integral upstanding portions with apertures near upper ends thereof and having adjacent its rear edge a recessed elongate seat for a die plate, said seat extending longitudinally between said upstanding portions and having therein a plurality of like holes spaced longitudianlly from one another, an elongate die plate extending longitudinally between said upstanding portions and seated in said recessed seat with an upper surface substantially flush with said upper surface of said base, said die plate being supported by said base throuthout its length and width and having in a forward portion thereof a plurality of punch holes spaced longitudinally from one another and coincient with but slightly smaller than said holes in said base, an elongate unitary punch holder extending longitudinally between said upstanding portions and having a rear portion seated on a rear portion of said die plate and a forward portion overlying and having a lower face spaced upwardly from a forward portion of said due plate, said punch holder having a plurality of vertical punch-receiving bores spaced longitudinally from one another and aligned with said punch holes of said due plate, fastening means extending through longitudinally spaced, aligned holes in rear portions of said punch holder, said die plate and said base to secure said die plate and punch holder to said base, a plurality of punches each having a cylindrical stem snugly receivable respectively in said bores of said punch holder and an enlarged head at the upper end of said stem, said punches being slidably and removably received in selected ones of said bores of said punch holder, and a compression spring surrounding the stem of each punch and acting between said head and an upper surface of said punch holder to position said punch in an upper position when said punch is inserted in a said bore of said punch holder, and elongate punch actuating means having at opposite ends thereof pivot portions with apertures aligned with apertures of said upstanding portions of said base and pivot pins extending through said aligned apertures of said pivot portions and said upstanding portions to support said elongate punch actuating means pivotally on said upstanding portions with its pivotal axis disposed rearwardly of said punches in said bores, said punch actuating means having an elongate rear portion overlying said elongate punch holder and an integral forwardly disposed integral elongate handle portion movable manually between an upper position and lower position, and an elongate longitudinally extending contact bar disposed on an under side of said rear portion of said actuating means and forwardly of said pivotal axis in position for engagement with said heads of punches in said bores of said punch holder to move said punches from an upper position in which lower ends of said punches are above said lower face of said forward portion of said punch holder to a lower position in which lower ends of said punches enter said holes in said die plate.

2. A paper punch according to claim 1, in which said base has a longitudinally extending groove disposed at the front edge of said recessed die plate seat of the base, and in which said die plate is an elongate bar of angular cross section with a horizontal portion which is seated in said recessed seat and in which said longitudinally spaced holes are provided and with a down-turned flange extending into said groove in said base.

3. A paper punch according to claim 1, in which said fastening means comprises rivets extending through said aligned holes in said punch holder, said die plate and said base.

4. A paper punch according to claim 1, in which said elongate punch holder is a die casting comprising an upper surface, longitudinally extending front, intermediate and rear flanges extending down from said upper surface, longitudinally spaced column portions extending down from said upper surface between said front and intermediate flanges and bored to provide said punch-receiving bores, and webs connecting said column portions with said front and intermediate flanges.

5. A paper punch according to claim 4, in which said die casting of said punch holder has in said rear portion thereof longitudinally spaced walls extending down from said upper surface and having at their lower ends bottom walls with holes in said bottom walls, said fastening means securing said punch holder and die plate to said base comprising rivets extending through said holes in said bottom walls of said wells and aligned holes in said die plate and base.

6. A paper punch according to claim 1, in which the upper surfaces of said heads of said punches are rounded and in which said punch actuating means comprises a die casting, said contact bar comprising a round steel bar secured between two longitudinally extending ribs on an under side of said die casting and engageable with said rounded heads of said punches with a rolling action.

7. A paper punch according to claim 6, in which said punch actuating means comprises an elongate die casting with a rear portion pivotally mounted on said base and carrying said punch contact bar, a downwardly extending flange at the front of said rear portion, an integral elongate forward handle portion spaced forwardly from said rear portion, and two end portions connecting opposite ends of said handle portion with opposite ends of said rear portion and constituting the sole connection between said rear portion and said handle portion.

8. A paper punch according to claim 6, in which the stems of said punches are steel and the heads are of compacted powdered metal with a porous structure containing lubricant.

9. A paper punch according to claim 1, in which said punch holder has parking bores adapted to store punches not currently being used, said parking bores being positioned rearwardly of said punch-receiving bores and approximately in the vertical plane of the pivotal axis of said punch actuating means in positions in which punches therein are not engageable by said contact bar, and being of oval cross section at their upper ends with the major axis of such oval transverse to the length of said punch holder.

10. A heavy duty paper punch according to claim 1, in which said pivot portions of said punch actuating means comprise at each end of said punch actuating means a pair of apertured pivot portions receiving the respective upstanding portion of said base between them.

11. A heavy duty paper punch comprising:

an elongate generally rectangular die cast base having an upper surface, a front edge, a rear edge and opposite ends, said base having at opposite ends thereof integral upstanding portions with apertures near upper ends thereof. and having adjacent its rear edge a recessed elongate longitudinally extending seat for a die plate, said seat having in a forward portion a row of holes spaced longitudinally of said base and a longitudinally extending groove at the front of said seat, an elongate die plate seated in said seat and having an upper surface substantially flush with said upper surface of said base, said die plate having in a forward portion thereof a row of punch holes registering with said holes in the base and having at its forward edge a down-turned flanges received in said groove, an elongate die cast punch holder having a rear portion seated on a rear portion of said die plate and a forward portion overlying and having a lower face spaced upwardly from a forward portion of said die plate, said punch holder having in said forward portion thereof a row of vertical punch-receiving bores spaced longitudinally from one another and aligned with said punch holes of said die plate, rivets extending through aligned holes in rear portions of said punch holder, said die plate and said base to secure said punch holder and die plate to the base, a plurality of punches each having a cylindrical stem snugly receivable respectively in said bores of said punch holder and an enlarged head at the upper end of said stem, said head having a rounded upper surface, said punches being selectively and removably insertable in said bores of said punch holder, and a compression spring surrounding the stem of each punch and acting between said head and an upper surface of said punch holder to position the punch in an upper position when said punch is inserted in a bore of said punch holder, and punch actuating means for moving said punches from said upper psition to a lower position in which said punches enter holes in said die plate, said actuating means comprising an elongate die casting having at opposite ends thereof pivot portions with apertures aligned with apertures of said upstanding portions of said base and pivot pins extending through said aligned apertures of said pivot portions and said upstanding portions to support said actuating means pivotally on said upstanding portions of said base with its pivot axis disposed rearwardly of said punches, a downwardly projecting longitudinally extending flange at the forward edge of said rear portion, an integral elongate forward handle portion spaced forwardly from said rear portion, two integral end portions connecting opposite ends of said handle portion with opposite ends of said rear portion and a round contact bar secured on an underside of said rear portion forwardly of said pivot axis of said punch actuating means in position to engage said rounded heads of said punches with a rolling action to force said punches downwardly.

12. A heavy duty paper punch according to claim 11, in which said pivot portions of said elongate die casting of said punch actuating means comprises at each end of said elongate die casting a pair of apertured pivot portions receiving the respective upstanding portion of said base between them.

13. A heavy duty paper punch comprising: an elongate, generally rectangular base having an upper surface, a front edge, a rear edge and opposite ends, said base having integral upstanding portions at opposite ends thereof and having adjacent its rear edge a recessed elongate longitudinally extending seat for a die plate, said seat having therein a plurality of like holes spaced longitudinally from one another, an elongate die plate seated in said recessed seat and having an upper surface substantially flush with said upper surface of said base, said die plate being supported by said base throughout its length and width and having in a forward portion thereof a plurality of punch holes spaced longitudinally from one another and coincident with but slightly smaller than said holes in said base, an elongate unitary punch holder having a rear portion seated on a rear portion of said die plate and a forward portion overlying and having a lower face spaced upwardly from a forward portion of said die plate, said punch holder having a plurality of vertical punch-receiving bores spaced longitudinally from one another and aligned with said punch holes of said die plate, fastening means extending through longitudinally spaced, aligned holes in rear portions of said punch holder, said die plate and said base to secure said die plate and punch holder to said base, said fastening means comprising rivets extending through said aligned holes in said punch holder, said die plate and said base, said rear portion of said elongate punch holder having on its lower face longitudinally spaced pads in the vicinity of said rivets and engaging said die plate, portions of the lower face of said punch holder between said pads being thereby slightly spaced from said die plate, a plurality of punches each having a cylindrical stem snugly receivable respectively in said bores of said punch holder and an enlarged head at the upper end of said stem, said punches being slidably and removably received in selected ones of said bores of said punch holder, and a compression spring surrounding the stem of each punch and acting between said head and an upper surface of said punch holder to position said punch in an upper position when said punch is inserted in a said bore of said punch holder, and elongate punch actuating means pivotally mounted at its ends of said upstanding portions of said base at opposite ends thereof with its pivotal axis disposed rearwardly of said punches in said bores for movement from an upper position to a lower position, said punch actuating means having a forwardly extending handle portion for manual movement of said punch actuating means from said upper position to said lower position and a longitudinally extending contact bar disposed forwardly of said pivotal axis and engageable with said heads of punches in said bores of said punch holder to move said punches from an upper position in which lower ends of said punches are above said lower face of said forward portion of said punch holder to a lower position in which lower ends of said punches enter said holes in said die plate.

14. A paper punch according to claim 13, in which said pads comprise spaced die-plate engaging portions on opposite sides of and spaced from each of said rivets, portions of said punch holder between said die plate engaging portions being flexed slightly by the setting of said rivets and resiliently holding said punch holder fixed on said die plate and base.

* * * * *